United States Patent [19]

Walker

[11] 4,417,362

[45] Nov. 29, 1983

[54] BATHROOM FIXTURE

[76] Inventor: Frank S. Walker, 40 Cedar Ave., Natick, Mass. 01760

[21] Appl. No.: 334,167

[22] Filed: Dec. 24, 1981

[51] Int. Cl.[3] ..... A47K 7/02

[52] U.S. Cl. ..... 4/606; 4/605; 15/160; 15/210 R

[58] Field of Search ..... 4/606, 605, 661; 15/160, 210 R

[56] References Cited

U.S. PATENT DOCUMENTS

| | | | |
|---|---|---|---|
| 1,889,494 | 11/1932 | Priest | 15/160 X |
| 2,752,622 | 7/1956 | Farber | 15/160 X |
| 3,209,372 | 10/1965 | Boyett, Sr. et al. | 4/606 |
| 3,289,215 | 12/1966 | Kennedy | 4/606 |
| 3,478,369 | 11/1969 | Ensley | 4/606 |
| 3,612,044 | 10/1971 | Gurrola | 15/160 UX |
| 3,631,560 | 1/1972 | Atkins | 15/160 UX |
| 3,750,226 | 8/1973 | Morgan | 4/606 X |
| 4,020,519 | 5/1977 | Robinson | 4/606 X |
| 4,336,623 | 6/1982 | Lin | 4/606 X |

FOREIGN PATENT DOCUMENTS

| | | | |
|---|---|---|---|
| 563146 | 6/1975 | Switzerland | 15/210 R |

*Primary Examiner*—Henry K. Artis

[57] ABSTRACT

The present device provides a complete stationary unit including brushes and sponges. The unit is removeable affixed to a tub or shower wall wherein the bather can, by his or her own movement against the brushes and sponges in the unit easily and efficiently wash his or her back or other inaccessible parts of their bodies. The device includes a soap dispencer which dispences liquid soap onto the brushes and sponges as they are contacted by the user's body.

1 Claim, 5 Drawing Figures

BATHROOM FIXTURE

BACKGROUND OF THE INVENTION

The invention resides in the field of bathroom fixtures and to a device for washing a person's back, in particular.

DESCRIPTION OF THE PRIOR ART

Prior to the present invention substantially all of the bathroom fixtures adapted for use in assisting persons to wash their backs and other inaccessible portions of their bodies of which I am aware consist of long handle brushes and the like. In most cases it is nearly impossible to scrub one's back with any degree of efficiency with the devices now on the market. In addition to brushes, sponges, wash clothes and other similar devices have been used and are used daily by persons taking a bath.

The present device provides a complete stationary unit including brushes and sponges. The unit is removeable affixed to a tub or shower wall wherein the bather can, by his or her own movement against the brushes and sponges in the unit easily and efficiently wash his or her back or other inaccessible parts of their bodies.

The brushes and sponges are removeable and easily changed after each use if desired.

FIELD OF THE INVENTION

The invention in its preferred form has for a principal object to provide a novel and improved bathroom fixture particularly constructed to enable a bather to wash his or her back and/or other inaccessible portions of their body in an efficient manner.

Another object of the invention is to provide a novel and improved back washer device characterized by novel structure wherein a plurality of washing devices are incorporated in a complete unit.

A still further object of the invention is the provision of a novel and improved device which may be readily and easily stored in the bathroom when not in use.

A further object of the present invention resides in the provision of a bathroom device character by novel structure whereby the washing units are removeable and readily cleanable or replaceable after each use of the device.

DRAWINGS

In the drawings illustrating the present invention:

SUMMARY OF THE INVENTION

Figure 1:
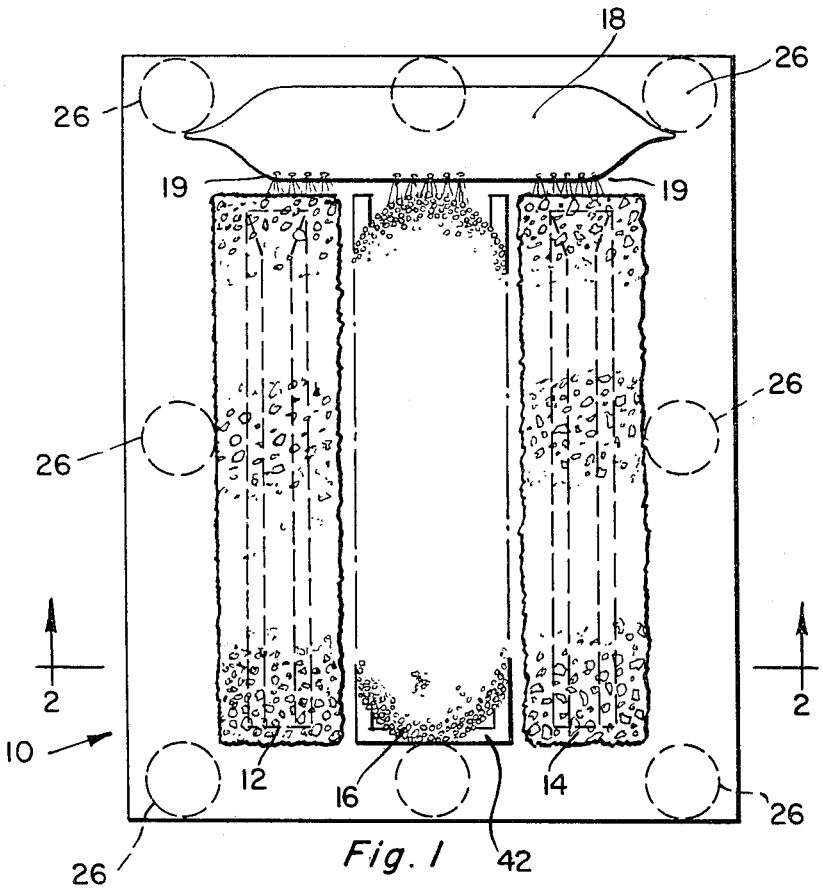
FIG. 1 is a front elevation of the preferred form of the present invention.
Figure 3:
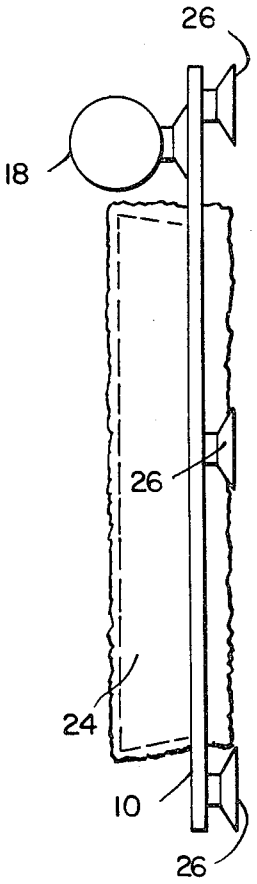
FIG. 3 is a side elevation of the device illustrated in FIG. 1.

Referring now to the drawings illustrating the preferred embodiment of the present invention, and to FIG. 1 in particular illustrating the present novel and improved invention. As shown 10 illustrates a substantially rectangular base member having sufficient stiffness to support sponge members 20, 24 in slots 12, 14 and brush members 22 within channel 30 defined by longitudinal flanges 32. Supported at one end of the base 10 and extending perpendicularly to the slots 12, 14 and channel 30 is an elongated hollow soap dispenser 18.

The soap dispenser 18 is adapted to be filled with liquid soap to be dispensed through a series of holes 19 therein and onto the sponge 16 and brushes 12, 14 during use of the device.

A plurality of suction cups 26 are mounted on one side of the base member 10 for enabling the unit, i.e., base and cleaning members (sponges and brush) to be removeable attached to the wall surface of a shower or bathtub.

Figure 2:
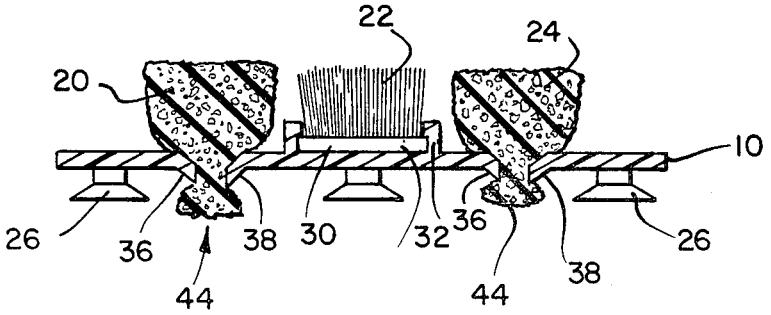
FIG. 2 is a cross-section of the device taken on the line 2—2 of FIG. 1.

Referring now to FIG. 2 for a more detailed illustration and description of the novel sponge slots 12, 14 and brush holding channel 30. As shown slots 12, 14 each comprising a pair of tapered flanges 36, 38. The flanges being bent inwardly to form a V-shaped slot having a wide mouth portion and a narrow elongated opening 12, 14. The V-shaped sponge carrying slots are extended longitudinally parallel to each other and are spaced a short distance from the brush carrying channel 16 as shown.

Also as best shown in FIG. 2 longitudinally extended in spaced relation to slots 12, 14 in channel 30 defined by spaced flanges 32 arranged to receive there between the base member 40 of brush 22. The lower end 42 of channel member 30 is closed to retain the brush therein and the opposed end is open to receive the brush 22 when assembling the unit.

In order to assemble the present unit prior to its attachment to the bathtub or shower wall each elongated sponge member is inserted into the upper end of its respective slot and is drawn downwardly so that a bulbous portion 44 of the sponge is squeezed through the slot expanding naturally on the opposite side of the base thus holding the wider sponge surface firmly in place with a major portion of the sponge 22 exposed for contact with the user's back.

The brush member 22 is readily assembled relative to the base member 10 by sliding the base portion 42 of the brush 22, adapted to fit therein, into the open end of channel 30 until the brush is fully seated in the channel, the bristles extend outwardly in the manner of the sponges. As shown, each of the sponges and brush member extend substantially the full length of the slots and channel to whereby provide a substantial sponge-brush surface for scrubbing the bather's body in the manner to be herein after described.

In operation the assembled unit 10 is adhered to the wall of a bathroom shower at the height desired above the floor thereof by means of the suction cups 26. The position of the unit may be easily adjusted to the proper position depending upon the height of the user or if desired may be secured to the back of the bathtub in position to receive the user's back to scrub the same while the bather is seated in the tub.

In use the bather merely presses the portion of his or her body against the sponge, brush unit and with movement of his or her body the heretofore inaccessible body portions are readily cleaned.

Another important feature of the invention resides in the fact that the brush and sponges may be changed and sponges of different characteristics as well as stiffer or softer brushes may be used. Each cleaning element may be detached from the bath or wall and cleaned before the next use.

Figure 4:
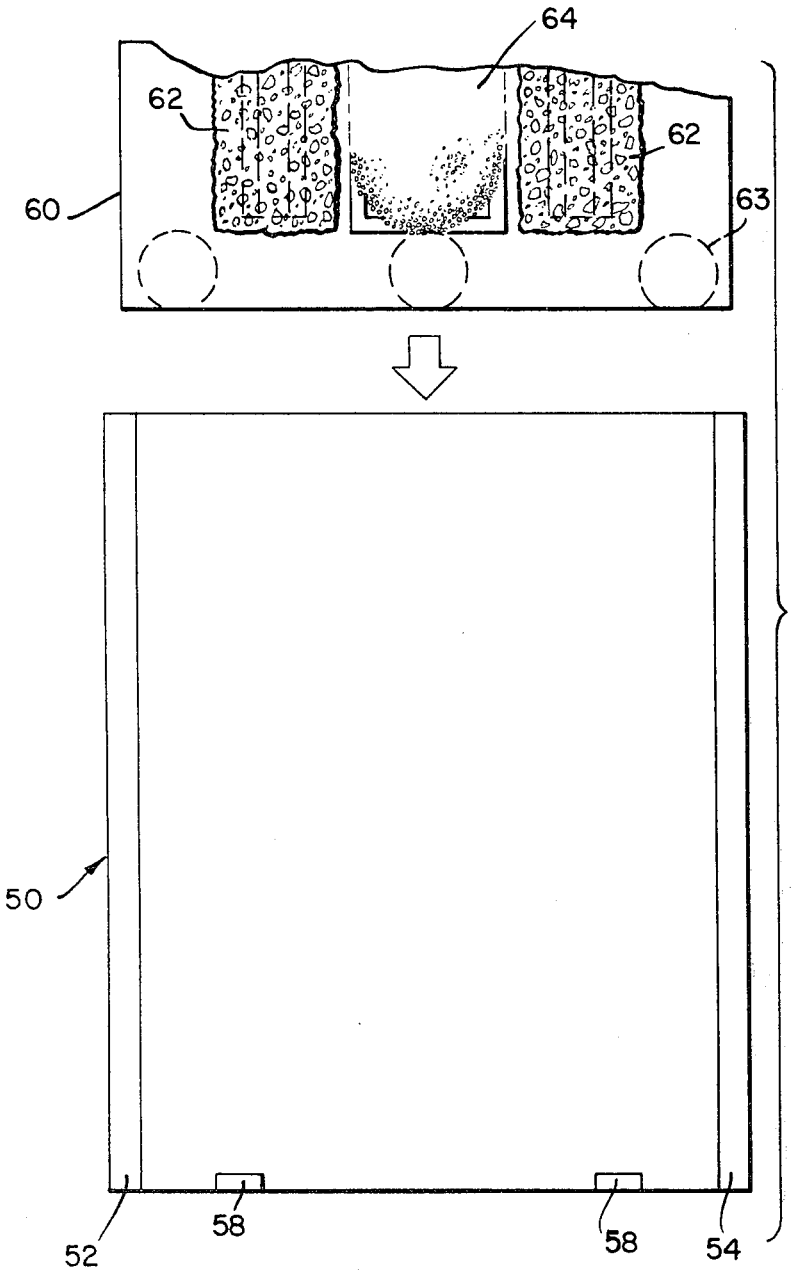
FIG. 4 is a front elevation illustrating a modified form of the present invention.
Figure 5:
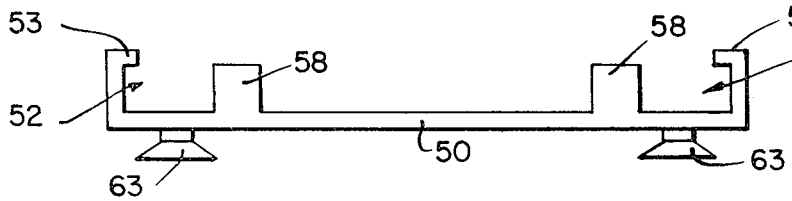
FIG. 5 is a cross-section taken on the line 4—4 of FIG. 4 further illustrating the modified form of the invention.

Referring now the FIGS. 4 and 5, a modified form of the invention is illustrated wherein a substantially rectangular sheet 50 of plastic material is provided with a channel 52, 54 defined by flanges 53, 55 along each edge of one face thereof and stop members 58 are secured or otherwise provided along the bottom of the sheet 50. The channels 52,54 are arranged to receive a similar sheet of plastic or like material 60 to which are attached aligned sponges 62 and a brush 64 similar to the assembly shown in FIG. 1. The sponges 62 and brush 64 are mounted in slots in the sheet 60 in the manner and by means of structure similar to that shown in FIGS. 1 and 2. In practice the sheet 50 is removeably secured by means of suction cups 63 or the like to the wall of the shower or tub, not shown, at a position so that the user's back will comfortably meet the sponge-brush surface in order that the back may be easily scrubbed as described in connection with the form of the invention shown in FIG. 1. Once the base member 50 is secured in position by pressing suction cups against the shower or tub surface the sheet 60 carrying the sponges and brushes is slid into the open end of the area defined by channels 52, 54 and seated against stop members 58. Thus the device is now ready for use.

One of the advantages of the structure of this form of the invention resides in the fact that each member of a family can have its own sheet 60 with their own particular type of assembly of sponges and/or brush for their own use.

While the present invention has been illustrated and described as embodying a single brush and multiple sponges it will be understood that many other variations of brush, sponge combinations may be utilized within the scope of the present invention or the assembly may comprise sponges only or brushes only.

From the foregoing description it will be apparent that the present invention provides a novel and improved and highly efficient device for assisting a bather to wash and cleanse inaccessible portions of his or her body. The device is relatively inexpensive to produce and is capable of being easily cleaned and stored in the user's bathroom when not in use.

Another advantage of the invention lies in its usefulness in massaging the aching joints, or bursitis of the elderly while being used primarily as a cleaning device.

Having thus described the present invention, what is claimed is:

1. In a bathroom fixture a base member and a plurality of cleansing elements detachably secured to said base member in a predetermined relation to said base member and extending outwardly therefrom for engagement with the body of a bather, said base member having means for mounting the same on a wall of a shower for enabling the cleansing elements to be readily engaged by the body of the bather, said means said means for cleansing the body of the bather comprising a plurality of sponges and a brush, said sponges being mounted in spaced parallel V-shaped grooves formed in said base member with a portion of said sponges inserted into said grooves to extend through the grooves on both sides of the base member, a U-shaped channel formed on a surface of said base member between said V-shaped grooves into which a brush is inserted such that the bristles of the brush extend outwardly forming a discontinuous surface against which the bather may rub his body, a liquid soap dispenser mounted at the upper end of said base member for dispensing soap onto the surface of said sponges and brush as the bather presses his body against the surfcae of said sponge-brush assembly, said means for detachably securing the fixture to the shower wall comprising suction cups enabling said fixture to be positioned on the shower wall in various desired positions to facilitate the engagement of the body of the bather relative to the cleansing surface.

* * * * *